US005857940A

United States Patent [19]

Husted

[11] Patent Number: 5,857,940

[45] Date of Patent: Jan. 12, 1999

[54] LOW IMPACT SIMULATED STRIDING DEVICE

[76] Inventor: Royce H. Husted, R.R. 4, Box 550, Forest, Va. 24551

[21] Appl. No.: 115,200

[22] Filed: Jul. 15, 1998

Related U.S. Application Data

[63] Continuation of Ser. No. 760,941, Dec. 6, 1996, Pat. No. 5,795,268, which is a continuation-in-part of Ser. No. 572, 638, Dec. 14, 1995, abandoned.

[51] Int. Cl.[6] ..... A63B 22/00; A63B 23/04

[52] U.S. Cl. ..... 482/51; 482/52; 482/70

[58] Field of Search ..... 482/51, 52, 53, 482/57, 70, 71, 79, 80

[56] References Cited

U.S. PATENT DOCUMENTS

| | | | |
|---|---|---|---|
| 4,850,585 | 7/1989 | Dalebout | 482/51 |
| 5,039,088 | 8/1991 | Shifferan | 482/51 |
| 5,290,211 | 3/1994 | Stearns | 482/53 |
| 5,299,993 | 4/1994 | Habing | 482/52 |
| 5,336,141 | 8/1994 | Vittone | 482/51 |
| 5,419,747 | 5/1995 | Piaget et al. | 482/51 |
| 5,496,235 | 3/1996 | Stevens | 482/51 |
| 5,527,251 | 6/1996 | Davis | 482/51 |
| 5,795,268 | 8/1998 | Husted | 482/52 |

*Primary Examiner*—Stephen R. Crow
*Attorney, Agent, or Firm*—Nicholas A Camasto

[57] ABSTRACT

An exercise device that simulates a striding action includes a base. Four linkages support two independently swingable side-by-side foot platforms from spaced apart front and rear supports secured to uprights that are connected to the base. The front and rear supports are positioned with respect to the foot platforms to substantially match the swing length of a person's leg. The distance between the front and rear supports is less than the distance between the front and rear pivots on the foot platforms. Outwardly extending handles are integral with the foot, platforms and are spaced farther apart than the distance between the foot platforms. The rear of each foot platform is slightly elevated with respect to its front.

7 Claims, 7 Drawing Sheets

LOW IMPACT SIMULATED STRIDING DEVICE

CROSS REFERENCE TO RELATED PATENTS AND APPLICATIONS

This application is a Continuation of application Ser. No. 08/760,941 filed Dec. 06, 1996, now U.S. Pat. No. 5,795,268 issued Aug. 18, 1998, which is a Continuation-in-Part of Ser. No. 08/572,638, filed Dec. 14, 1995, now abandoned.

BACKGROUND OF THE INVENTION AND PRIOR ART

This invention relates in general to exercise equipment and in particular to a low impact exercise device that simulates a full range of natural striding motion including aggressive striding. It also relates to a striding exercise device that is useful in performing upper body workouts.

The prior art includes a great number of exercise devices that simulate walking, a form of low muscle stress exercise that nearly everyone can perform The beneficial effects achievable by walking are in proportion to the effort expended. The well-known treadmill exercise machine exemplifies such apparatus.

Recently a variety of exercise devices that impose low or minimal impact on the user's knees and legs have become popular. While such devices generally provide some aerobic benefit, they often constrain the user's legs into a very unnatural locked-knee position. In such devices, the user stands on swingably mounted platforms that, for safety reasons, are interlocked to prevent both platforms from simultaneously moving in the same direction. While the interlocking reduces the danger of the user being placed in a precarious position, it unnaturally constrains the user's arm and leg motions and precludes long, natural, as well as aggressive, striding movements.

Handles that are linked to the foot platforms, either directly or indirectly, assist the user in maintaining balance. Even so, the combined foot and arm movements of the devices rarely simulate a natural striding motion. While a treadmill does simulate walking, it imposes impact loading on the user's body, especially on the knees and legs. For many users, this impact loading is undesirable and may even be detrimental.

The prior art also includes a number of so-called cross country skiing machines which attempt to simulate the body movements of a cross country skier. While such machines can provide a very strenuous low impact workout for the user, they are difficult to master, requiring a degree of user skill and balance similar to the sport itself.

The prior art devices generally constrain the range of movement to a small safety zone to preclude the user getting into an unbalanced and precarious position. The limited movements permitted in these devices do not allow for a long, natural striding motion, much less aggressive striding motions, nor do they enable any significant weight transfer to the arms, which is necessary to obtain an upper body workout.

With the exercise device of the present invention, a full range of striding motion is very closely simulated while impact on the user's body is practically eliminated. Significantly, the aerobic effect experienced is readily controllable by merely accelerating the striding action and lengthening the stride, precisely as can be done when aggressively striding. However, unlike striding, with the inventive device a user can lean backward and forward to transfer significant weight to his am without loss of balance or control This not only increases the aerobic effort and enables an upper body workout, but also varies the muscle groups that are being exercised.

The inventive device is very comfortable and easy to learn and use, imparting a feeling of balance and stability to even the most novice of users. It also readily accommodates users of different strength and agility. Further, different muscles may be exercised by elevating on one's toes, bending one's knees or by grasping different portions of the handles. The handles move integrally with the foot platforms, in a natural manner, without requiring any linkage or interconnection between the handles or between the foot platforms, which are independently swingable.

OBJECTS OF THE INVENTION

A principal object of the invention is to provide a low impact exercise device that simulates natural and aggressive striding.

Another object of the invention is to provide a novel exercise device that simulates striding and enables safe upper body workouts.

A further object of the invention is to provide a low impact striding exercise device that is safe, comfortable and easy to learn and use.

BRIEF DESCRIPTION OF THE DRAWINGS

These and other objects and advantages of the invention will become apparent upon reading the following description in conjunction with the drawings, in which.

DESCRIPTION OF THE PREFERRED EMBODIMENT

Figure 1:
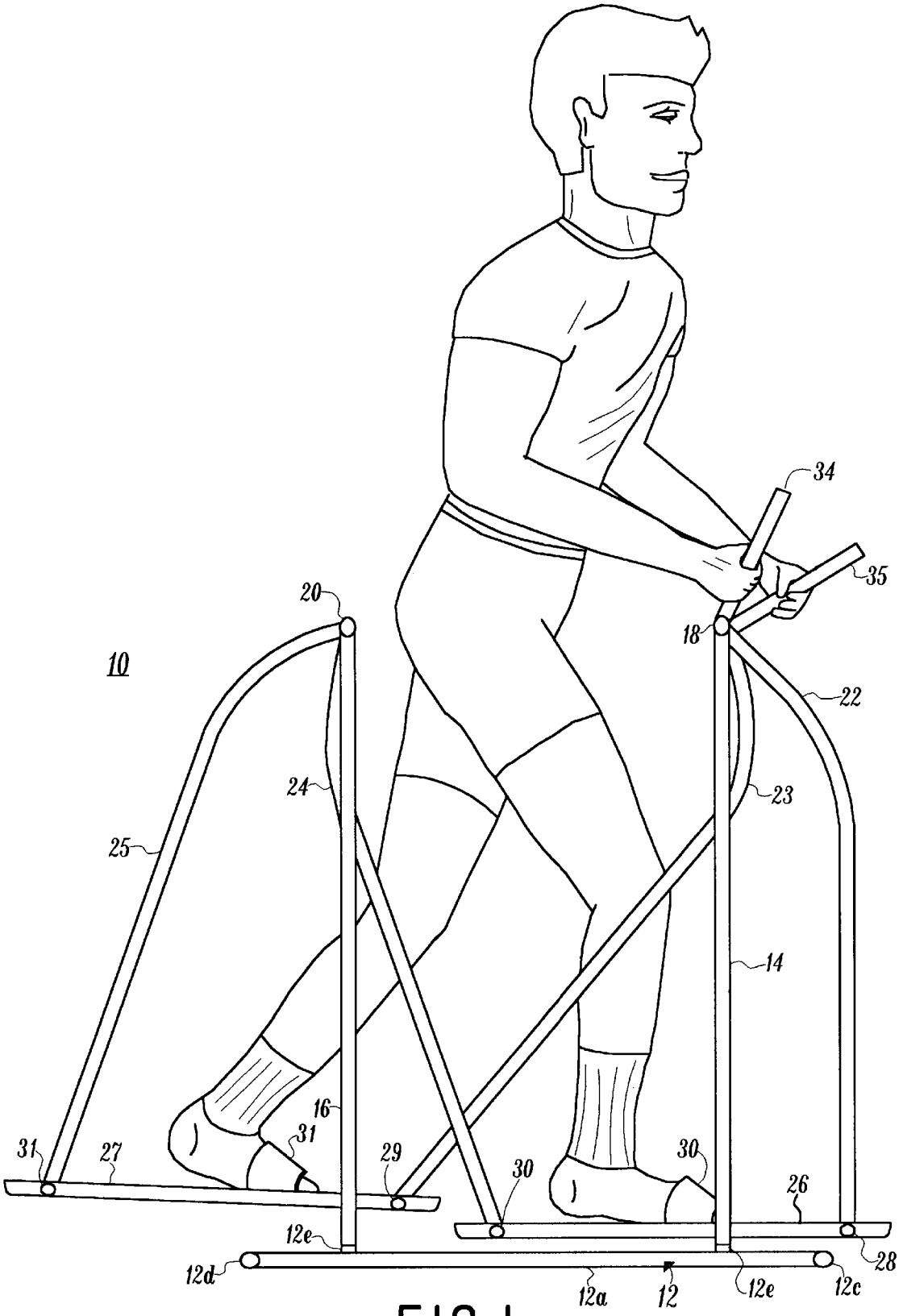
FIG. 1 is a side elevation of one version of the exercise device of the invention.

Referring to the drawings generally and in particular to FIGS. 1–4, a user is shown exercising on one version of the striding device 10 of the invention. A generally square base 12 includes side members 12*a* and 12*b*, a front member 12*c* and a rear member 12*d*. The side members 12*a* and 12*b* include short stubs 12*e* that engage and laterally support four vertical uprights 14, 15, 16 and 17. The frame members are fabricated from tubular steel with the various junctions between members being preferably welded. The stubs 12*e* are provided to enable the frame to be partially disassembled for convenient shipping.

A pair of front support hinge tubes 36 and 37, defining a front hinge axis, are supported by end rings that are secured to the tops or ends of the uprights, preferably by welding Thus, a front hinge axis is defined by the end rings 18 and 19 that are secured to the ends of uprights 14 and 15, respectively. Similarly a pair of rear support hinge tubes 38 and 39, defining a rear hinge axis, are supported by end rings 20 and 21 that are secured to the ends of uprights 16 and 17 (not shown), respectively.

A pair of flat, generally rectangular rigid foot platforms 26 and 27 is suspended from the front and rear support hinge tubes by a pair of linkages, respectively. Right foot platform 26 is pivotably supported at its front by a pivot pin 28 that engages a right front linkage 22 and at its rear by a pivot pin 30 that engages a right rear linkage 24. Similarly, the front of a left foot platform 27 engages a left front linkage 23 by a pivot pin 29 and the rear of the platform engages a left rear linkage 25 by a pivot pin 31. The front linkages 22 and 23 are outwardly bowed to provide knee clearance for those users who exercise vigorously by taking long aggressive strides while bending their knees. The rear linkages 24 and 25 are similarly outwardly bowed to permit hip swinging movements without interference. A pair of handles 34 and 35 extend outwardly and upwardly at an angle from the front of the exercise device 10 and a pair of foot stops 30 and 31 is secured to the tops of the foot platforms 26 and 27, respectively, near their forward ends.

Figure 3:
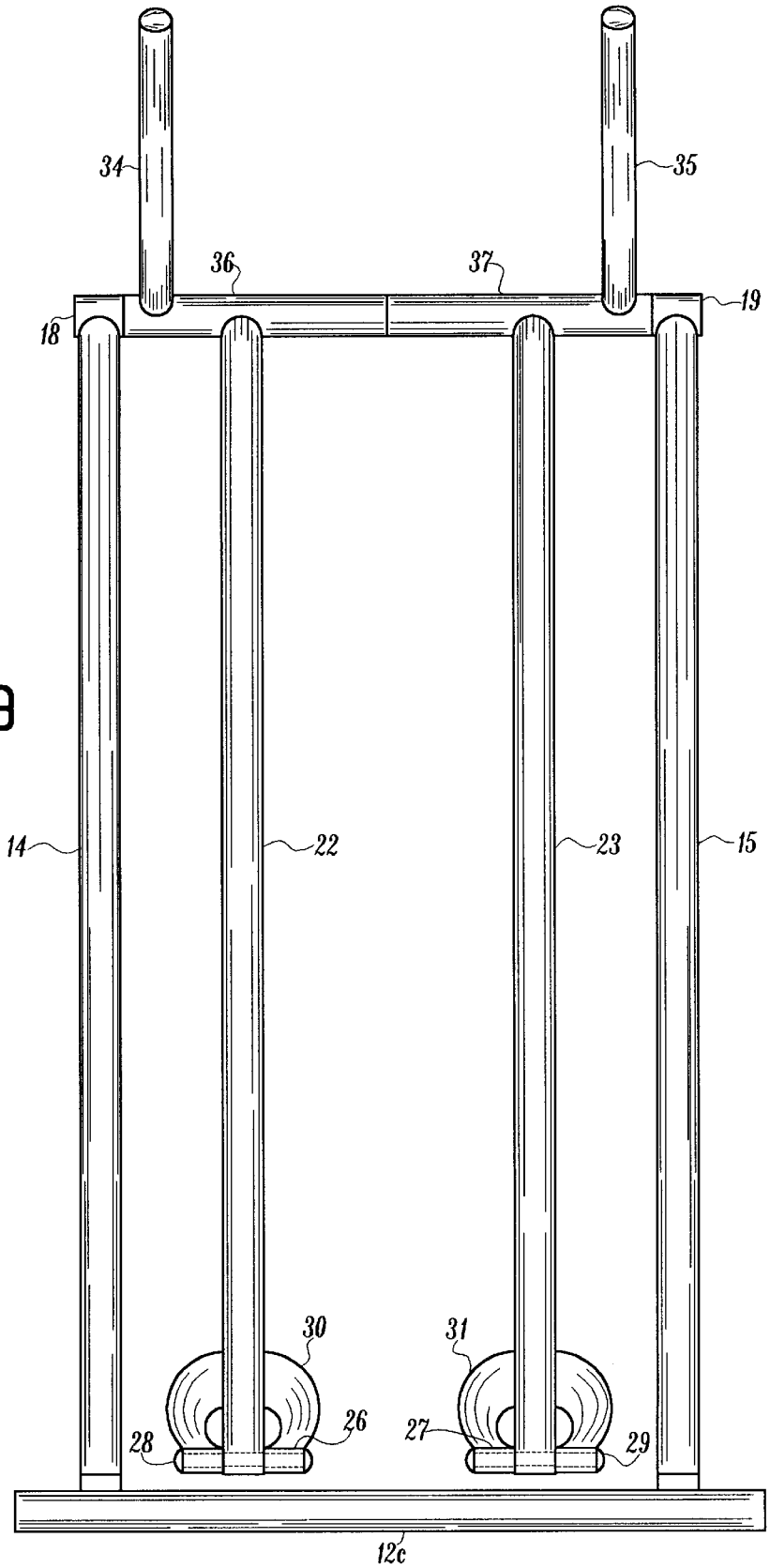
FIG. 3 is an enlarged front elevation of the exercise device.
Figure 4:
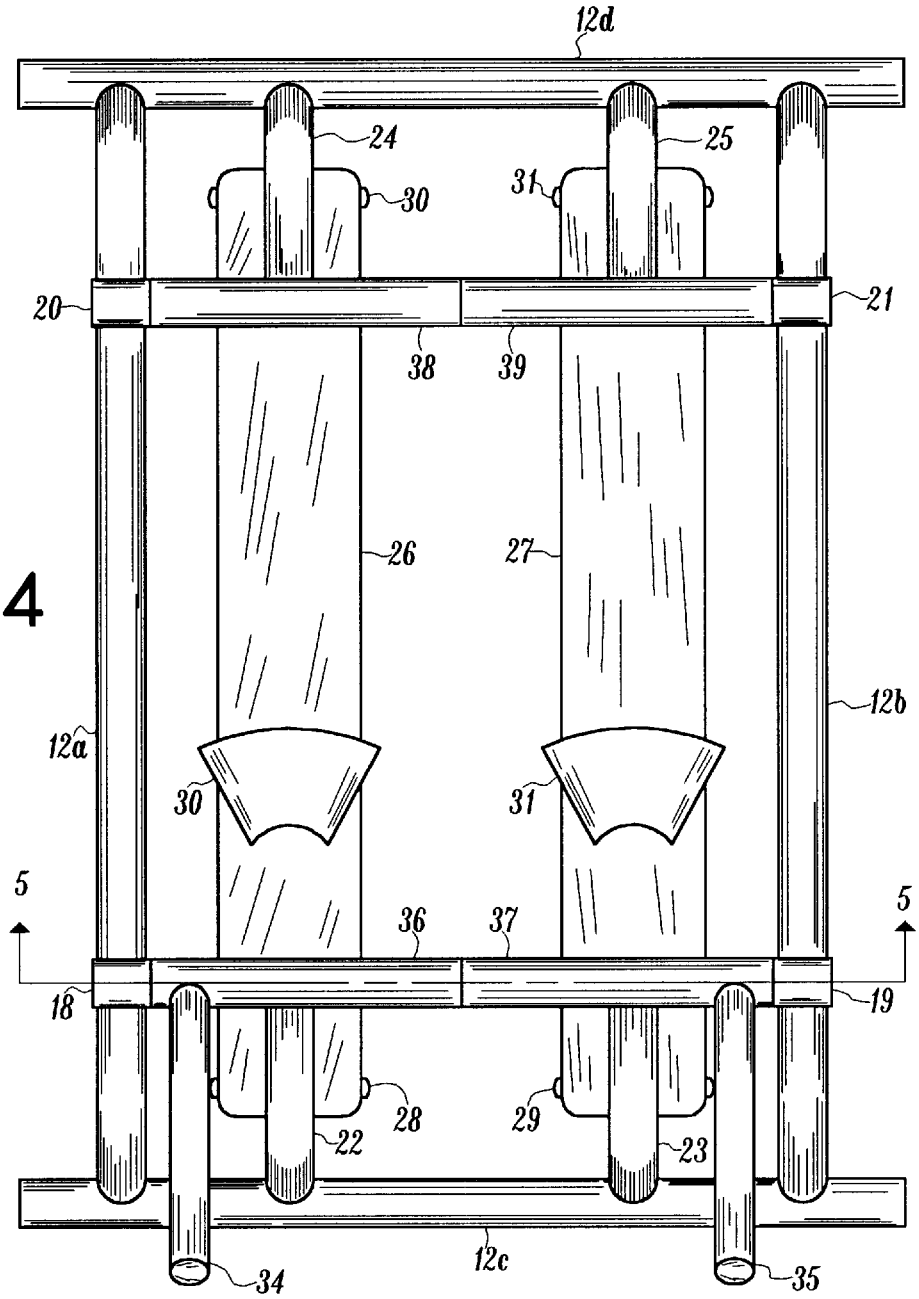
FIG. 4 is a plan view of the exercise device shown in FIG. 3.

With particular reference to FIGS. 3 and 4, handles 34 and 35 are seen to be affixed to the pair of front support hinge tubes 36 and 37, that are in turn affixed to front linkages 22 and 23, respectively. Hinge tubes 36 and 37 are rotatably mounted on a front bearing tube 40 (shown in FIGS. 5 and 6) that extends between end rings 18 and 19. The front bearing tube 40 serves as an axle for the front support hinge tubes. Rear support hinge tubes 38 and 39 are similarly rotatably mounted on a rear bearing tube (not shown) that extends between end rings 20 and 21, respectively. The front and rear support hinge tubes are thus centered about the front and rear hinge axes that extend between the respective pairs of front and rear end rings as discussed above.

Figure 5:
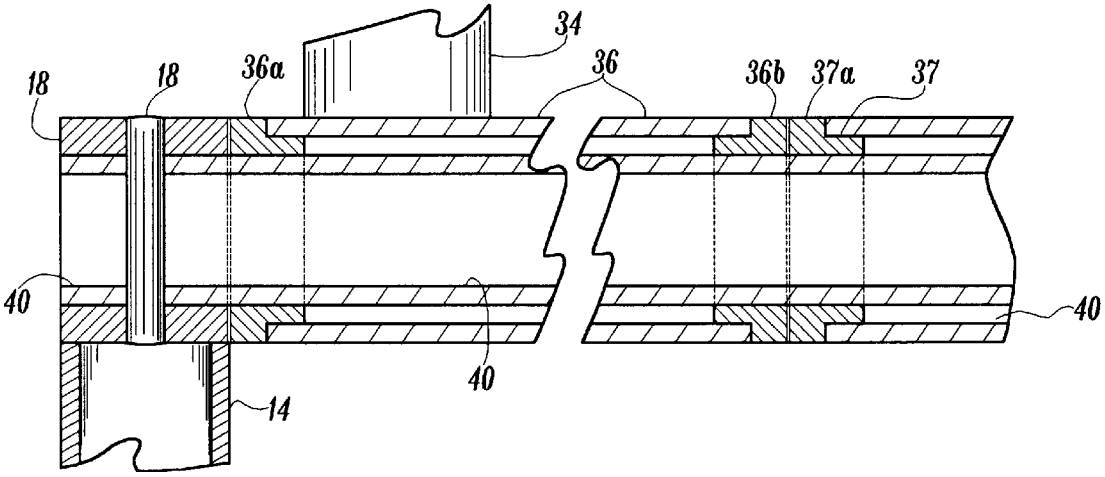
FIG. 5 is an enlarged partial cross sectional view taken along line 5—5 of FIG. 4.
Figure 6:
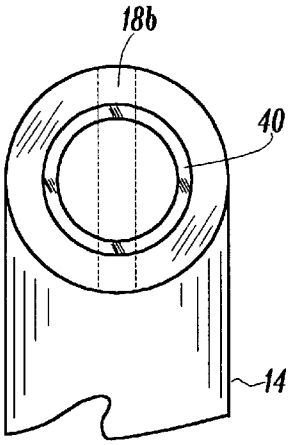
FIG. 6 is an end view of the structure of FIG. 5.
Figure 7:
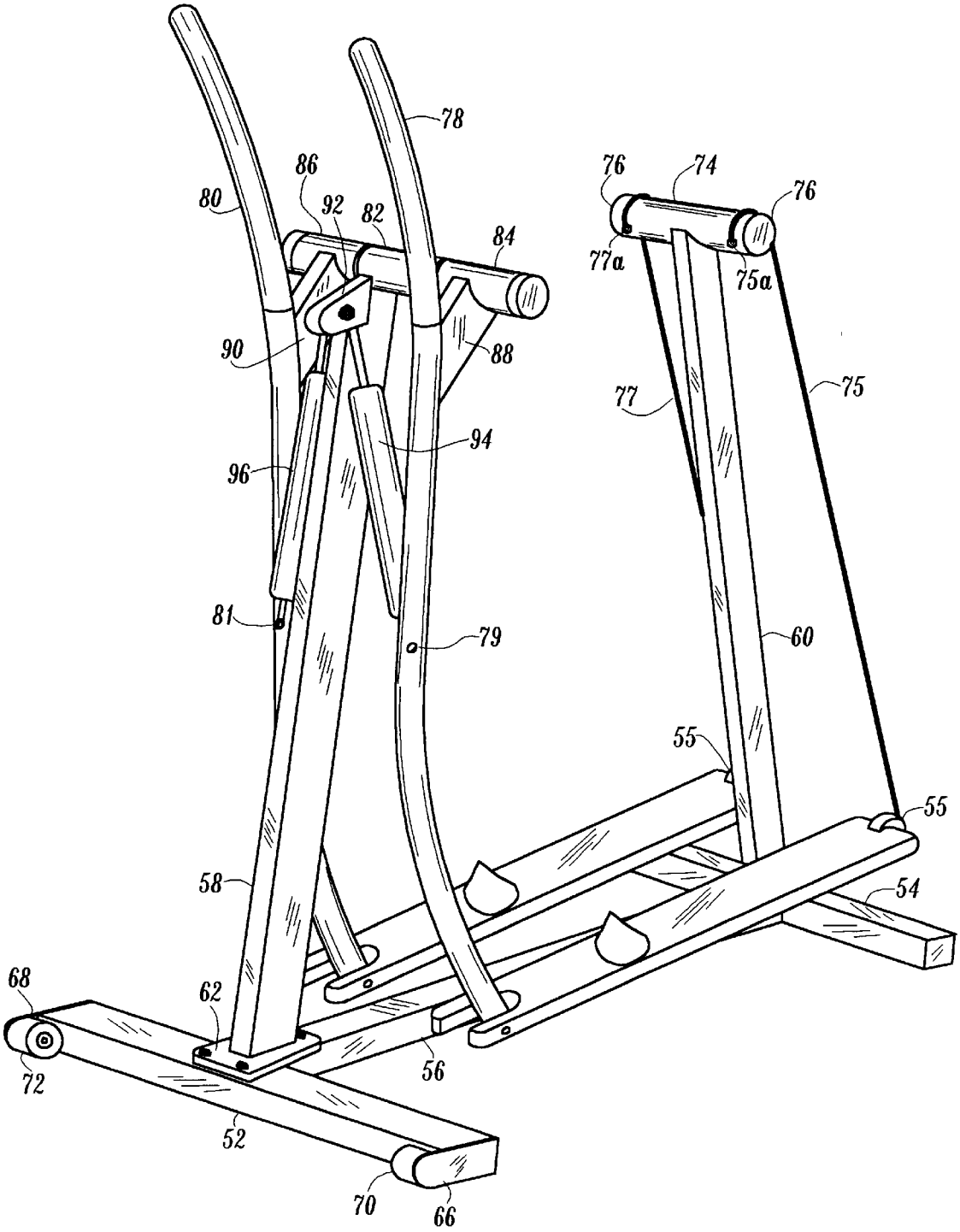
FIG. 7 is a perspective view of another version of the exercise device.

In the partial views of FIGS. 5 and 6, portions of front support hinge tubes 36 and 37 are shown, it being understood that front support hinge tube 37 is a mirror image of hinge tube 36. As mentioned, end ring 18 is welded to the top of upright 14 and receives the end of bearing tube 40 therein. The bearing tube 40 is secured in end ring 18 (and in end ring 19 at its other end) by a roll pin 18*a* that is inserted in aligned holes in the end ring 18 and the end of bearing tube 40. A pair of T bushings 36*a* and 36*b* support front support hinge tube 36 for rotatable motion about bearing tube 40. A similar arrangement is used for front support hinge tube 37 and its T bushings, only one of which (37*a*) is shown. The T bushings are preferably made of molded nylon and have appropriate diameter shoulders for securing them in the ends of the hinge tubes. The arrangement provides thrust bearing surfaces between the end rings and the T bushings, between the facing surfaces of T bushings 36*a* and 36*b* and between the front support hinge tubes and the bearing tube it will, of course, be recognized that the bearing tubes may be replaced by solid axles should that be desired.

The front and rear bearing tubes provide rigid bridges between the front uprights 14 and 15 and between the rear uprights 16 and 17, respectively. The front linkages 22 and 23 and the rear linkages 24 and 25 are spaced apart on their respective bearing tubes a distance that matches the spacing of an average person's feet. This configuration applies tension loading through linkages 22, 23, 24 and 25 and compression loading on the uprights 14, 15, 16 and 17.

Figure 2:
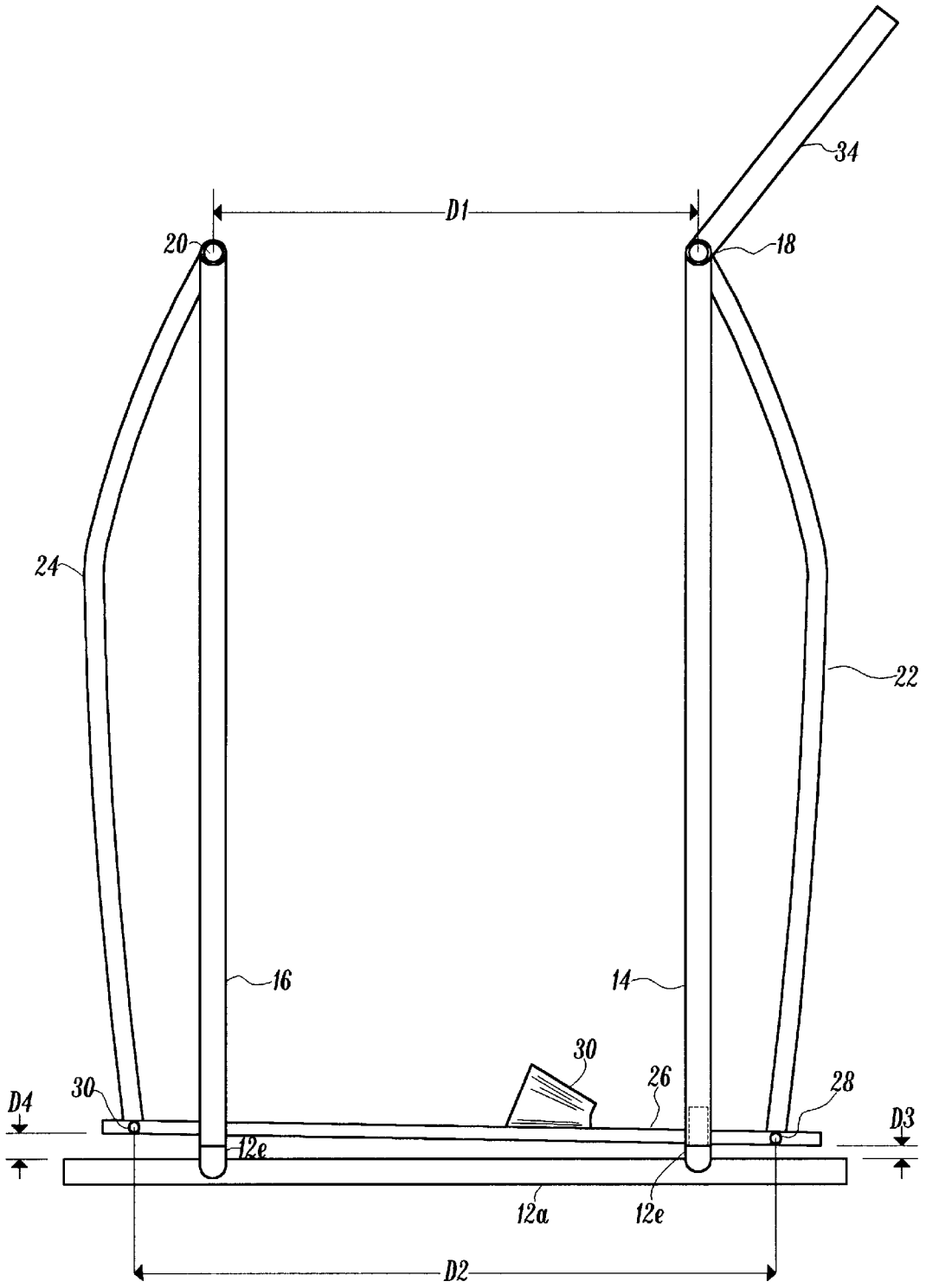
FIG. 2 is an enlarged side elevation of the exercise device.

Referring to FIGS. 1 and 2, some important aspects of the inventive device will be noted. The frame design, with its spaced apart uprights and its axes defined by front and rear supports, produces a stable structure with easy entry from either side. It will be noted that the foot platforms and the linkages depart slightly from a parallelogram shape. Specifically, the distance D1 between the end rings 18 and 20 is somewhat less than the distance D2 between the foot platform pivot pins 28 and 30. Also the height of the hinge axes defined by the front and rear pairs of end rings is chosen to match the swing radius of a person's leg, generally about hip high. This arrangement establishes a "zone of stability" for the user. As long as the center of mass of the user stays within the zone of stability, the user is not placed in a precarious position with respect to the machine, despite the fact that the foot platforms (or handles) are not interlinked in any way. The arrangement enables the user a great deal of freedom of movement in performing exercises, including very long natural and aggressive striding movements, and significant shifting of his weight forward or backward to transfer loading to his arms and hands. The solid restraining rails formed by the front and rear bearing tubes and support hinge tubes also provide safety stops should the user's center of mass move outside of the zone of stability while engaging in overly aggressive movements on the machine. It has been found that the zone of stability provides sufficient tolerance so that a machine designed to accommodate a person of average height and weight will enable most people to obtain substantially the full benefits of the invention, namely a long, natural striding motion and significant upper body workout, without losing their balance or being put in a precarious position. A person's weight positively biases the center of mass of the person toward a balance point within this zone of stability. In practice, the distance between end ring 18 and pivot pin 28 is approximately 95 centimeters and that between end rings 18 and 20 is approximately 54 centimeters.

The spacing of the front and rear axes (defined by the front and rear support hinge tubes) results in a flattening of the arc through which the foot platforms travel and enables the user's feet and ankles to bend in a more natural manner. It will also be seen that the rear of each foot platform is slightly higher than its front, as is indicated by the distances D3 and D4, where D4 is greater than D3. This arrangement insures that the user's feet stay firmly in contact with the toe grips, imparts a more rapid heel rise and minimizes any unnatural bending of the ankle at the forward extremity of a long stride.

Another aspect of the invention is the placement of the handles 34 and 35 relative to the user. The handles pivot in front of the user which accommodates a natural arm extension. The handles extend outwards and upwards from their pivot point which accommodates the natural reach of the user relative to height at which the handles are grasped. The handles are also spaced wider apart than the foot platforms for the comfort of the user.

The exercise device of the invention permits very easy entry from either side of the frame. Also the front support hinge tubes 36 and 37 and rear support hinge tubes 38 and 39, in conjunction with the beating tubes, form sturdy front and rear restraining rails for the security of the user.

In operation, a user enters the exercise device from either side, standing on the foot platforms and placing his feet within the corresponding foot stops. The handles 34 and 35 may be grasped or, alternatively, the user may hold on to the front support hinge tubes 36 and 37. For a mild walking exercise, the user should take short steps. The degree of arm effort is readily controllable and exerting more arm effort diminishes the effort required by the legs and vice versa. The wrists may be exercised in varying degrees by changing the position of the hands on the handles. For true natural striding, long steps are taken, with the degree of aerobic effort required being fully under the control of the user. By leaning forward or backward and by bending the knees or raising up on the toes, different upper and lower body groups of muscles may be exercised in varying degrees. For aggressive striding, very long steps are taken.

FIGS 7–10 illustrate another version of the invention, in which a pair of spaced apart uprights 58 and 60 are supported on a base having a front crossmember 52 and a rear crossmember 54 connected together by a center member 56 and suitable plates 62 and 64. Front crossmember 52 includes end plates 66 and 68 that support a pair of rollers 70, which are normally not in contact with the floor by virtue of support pads 71 on the underside of the base. The rollers enable easy relocation of the exercise machine by grasping rear crossmember 54 and lifting to transfer the load to the rollers. This arrangement also obviates movement of the machine during strenuous exercises which might otherwise occur if the rollers 70 were in contact with the floor. The various members are formed of tubular steel of rectangular cross section.

A stationary front support tube 82 is welded to the top of front upright 58 and supports an axle (not shown) upon which front support hinge tubes 84 and 86 are rotatably mounted. Suitable end caps 76 cover the ends of the front support hinge tubes. A pair of rigid front linkages 78 and 80 are secured to front support hinge tubes 84 and 86 by means of portions 88 and 90, respectively. The upper ends of the rigid linkages 78 and 80 form handles for a user to grasp. The bearing arrangement for the front support hinge tubes 84 and 86 is similar to that previously described, and include a bearing tube and suitable T bushings.

Figure 10:
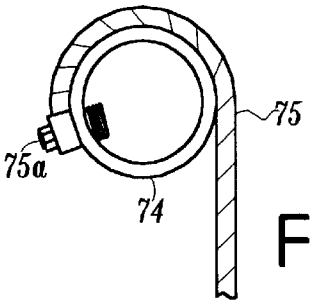
FIG. 10 is an enlarged partial cross sectional view taken along line 10—10 of FIG. 9.

A longer stationary rear support tube 74 is welded to the top of rear upright 60 and is enclosed by a pair of end pieces 76. A pair of rear flexible linkages, in the form of cables 75 and 77 whose upper ends are partially wrapped around the periphery of support tube 74, are affixed thereto by suitable fasteners 75*a* and 77*a*. This construction is best seen in FIG. 10. The cables support the rear ends of the foot platforms. The lower portions of the cables pass over generally circular guides 53 and 55 that are affixed to the rear ends of the foot platforms. The front ends of the foot platforms are pivotally secured to the lower ends of the rigid front linkages 78 and 80 by pivot pins. The cable guides 53 and 55 are preferably molded of high strength plastic.

It will be apparent that during swinging, the rear cables will wrap and unwrap on the support tube 74 and cable guides 55 thus changing its length slightly. As shown, the effects of wrapping on support tube 74 and unwrapping on cable guide 55 tend to offset each other. It will also be seen that cable 75 can be wrapped in a clockwise manner around support tube 74 to alter the effect.

Figure 8:
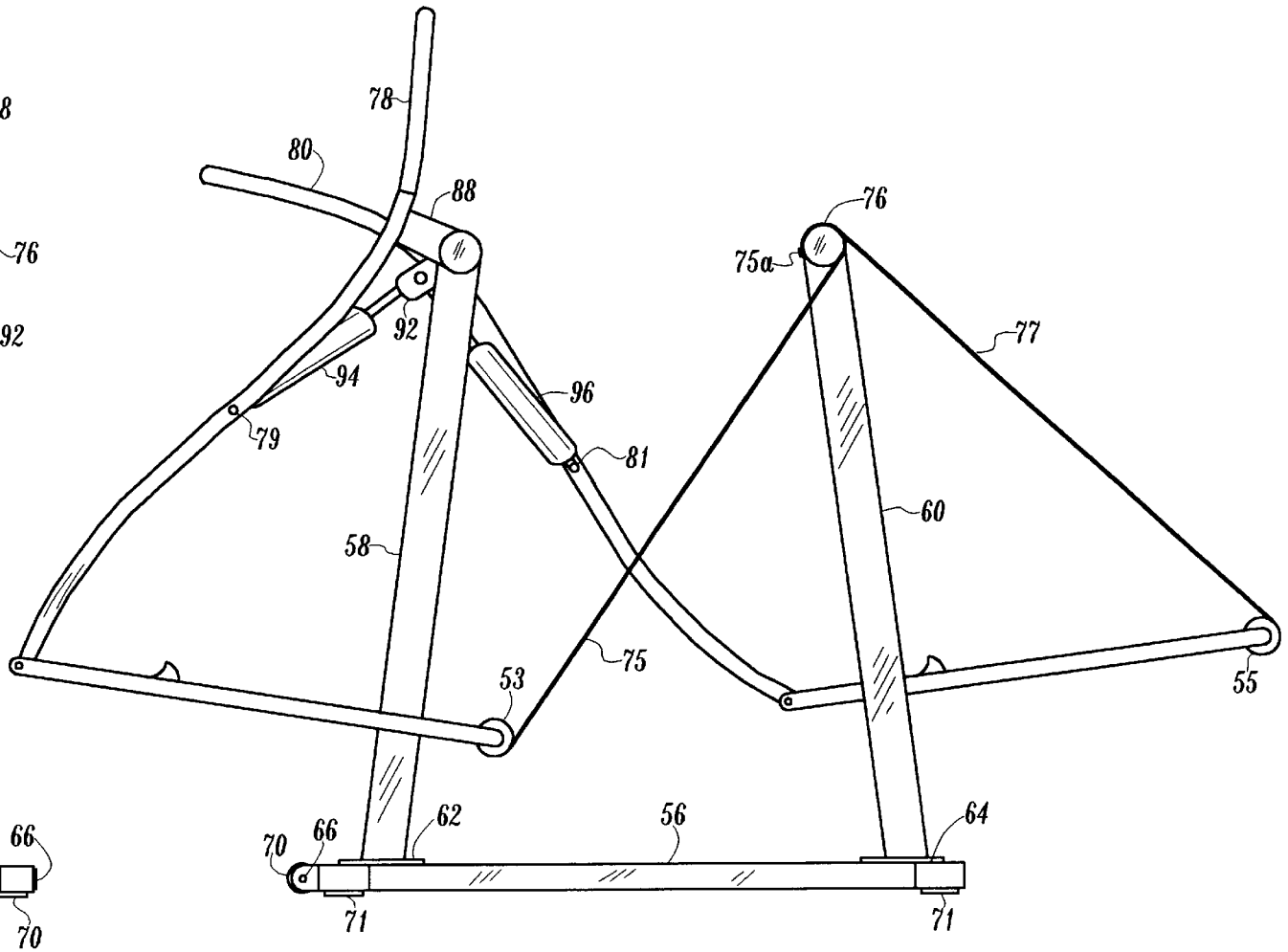
FIG. 8 is a reduced side elevation of the exercise device of FIG. 7, illustrating a long striding position.
Figure 9:
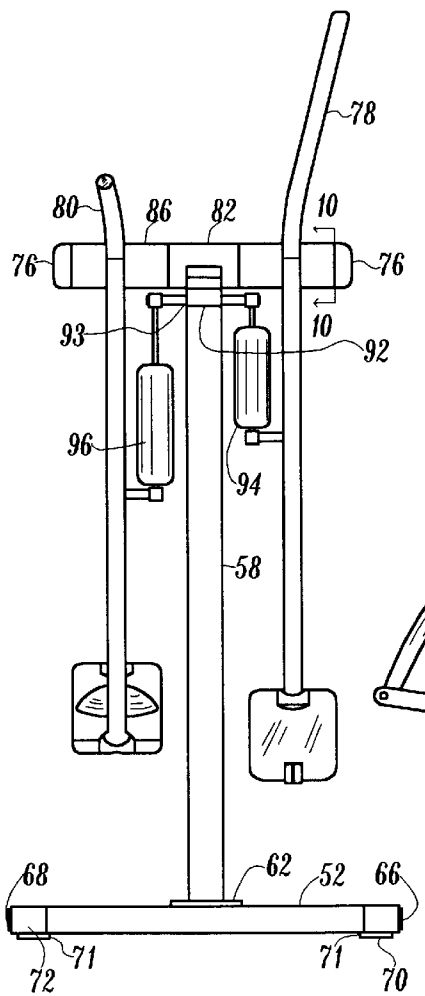
FIG. 9 is a front elevation of the exercise device illustrated in FIG. 8.

As more clearly shown in FIGS. 8 and 9, a pair of shock absorbers 94 and 96 are provided to increase the resistance experienced by the user and to therefore enable a more aerobic exercise session, if desired. An extension 92 on the front of front upright 58 supports an axle 93 to which one end of each of shock absorbers 94 and 96 is rotatably secured. The other ends of the shock absorbers are rotatably secured to respective ones of the rigid front linkages 78 and 80 by suitable pins 79 and 81, respectively. The shock absorbers may be of conventional design and arranged to be easily disconnected should the user prefer, or they may incorporate user-operable orifice changing mechanisms to vary their resistance. The base of the FIG. 7 version of the invention is bolted together at the plates 62 and 64, which enables the exercise machine to be conveniently shipped, while requiring very simple assembly by the user.

It will be appreciated by those skilled in the art, that the construction of both versions of the invention provide a strong and stable frame for the user. The bushings make for a completely silent exercise device which is of great benefit since a majority of users engage in television viewing or conversation while exercising.

What has been described is a novel exercise device that provides a low impact simulation of walking and striding, including aggressive striding, in addition to enabling both upper and lower muscles groups of the body to be exercised to the degree desired. It is recognized that numerous changes to the described embodiment of the invention will be apparent to those skilled in the art without departing from its true spirit and scope. The invention is to be limited only as defined in the claims.

What is claimed is:

1. An exercise machine for enabling a full range of free and natural and aggressive striding motion and for permitting an upper body workout while maintaining a safe and stable attitude comprising:

a pair of independently swingable rigid foot platforms;

a frame including upwardly extending members;

a tubular front support, including bearing means and hinge tubes rotatably coupled to said bearing means, and a rear support;

means for positioning said front and rear supports on corresponding ones of said upwardly extending members;

said front support and said rear support being spaced a distance apart so as to be located in front of and behind a person standing on said foot platforms;

pivot means near the ends of each of said foot platforms;

a rigid front linkage means and a rear linkage means coupled to said pivot means for swingably suspending said foot platforms from said front support and said rear support, respectively, at a height approximating the swing radius of a person's leg;

a pair of handles affixed to said rigid front linkage means;

the combination of said distance and said height establishing a zone of stability within which a person's center of mass may be safely moved while maintaining stability; and the weight of a person standing on said foot platforms positively biasing said center of mass to a balance point within said zone of stability.

2. The machine of claim 1, wherein said front linkage means and said rear linkage means suspend the rear of each of said foot platforms at a slightly higher elevation than the front of each of said foot platforms.

3. The machine of claim 1, wherein the length of each of said foot platforms between said front linkage means and said rear linkage means is greater than the distance between said front support and said rear support.

4. The machine of claim 1, wherein said pair of handles are spaced farther apart than the distance between said foot platforms.

5. The machine of claim 1, further including resistance means for loading said swingable foot platforms.

6. The machine of claim 5, wherein said resistance means comprise a pair of shock absorbers interconnecting said frame and said front linkage means.

7. An exercise machine for enabling a full range of free and natural and aggressive striding motion and for permitting an upper body workout while maintaining a safe and stable attitude comprising:

a pair of independently swingable rigid foot platforms;

a frame including upwardly extending members;

a tubular front support, including bearing means and hinge tubes rotatably coupled to said bearing means, and a rear support;

means for positioning said front and rear supports on corresponding ones of said upwardly extending members;

said front support and said rear support being spaced a distance apart so as to be located in front of and behind a person standing on said foot platforms;

pivot means near the ends of each of said foot platforms;

the distance between said pivot means being greater than the distance between said front and rear supports;

a rigid front linkage means and a rear linkage means coupled to said pivot means for swingably suspending said foot platforms from said front support and said rear support, respectively, at a height approximating the swing radius of a person's leg;

said front linkage means and said rear linkage means suspending the rear of each of said foot platforms at a slightly higher elevation than the front of each of said foot platforms;

a pair of handles affixed to said rigid front linkage means;

said pair of handles being spaced farther apart than the distance between said foot platforms;

a pair of shock absorbers interconnecting said frame and said front linkage means;

the combination of said distance between said front support and said rear support and said height establishing a zone of stability within which a person's center of mass may be safely moved while maintaining stability; and the weight of a person standing on said foot platforms positively biasing said center of mass to a balance point within said zone of stability.

* * * * *